United States Patent [19]

Menosso

[11] 4,228,623

[45] Oct. 21, 1980

[54] PREFABRICATED SELF-SUPPORTING MODULAR ROOM ELEMENTS

[76] Inventor: Ennio Menosso, via Papa Giovanni XXIII, Pradamano (Udine), Italy, 33040

[21] Appl. No.: 906,246

[22] Filed: May 15, 1978

[30] Foreign Application Priority Data

Mar. 3, 1978 [IT] Italy ..... 83346 A/78

[51] Int. Cl.[2] ..... E04H 9/06

[52] U.S. Cl. ..... 52/79.3; 52/79.4; 52/79.7; 52/79.9; 52/259; 52/587

[58] Field of Search ..... 52/79.2, 79.13, 79.7, 52/79.14, 431, 432, 227–229, 258, 259, 79.1, 79.3, 79.4, 234, 238, 94, 79.9, 292, 587

[56] References Cited

U.S. PATENT DOCUMENTS

| | | | |
|---|---|---|---|
| 2,223,016 | 11/1940 | Parkhurst | 52/293 |
| 2,645,114 | 7/1953 | Amirikian | 52/432 |
| 2,920,475 | 6/1960 | Graham | 52/587 |

FOREIGN PATENT DOCUMENTS

| | | | |
|---|---|---|---|
| 923088 | 2/1955 | Fed. Rep. of Germany | 52/432 |
| 2543508 | 10/1976 | Fed. Rep. of Germany | 52/79.14 |
| 1001455 | 10/1951 | France | 52/79.1 |
| 1166339 | 6/1958 | France | 52/259 |
| 672208 | 10/1964 | Italy | 52/79.14 |
| 354566 | 7/1961 | Switzerland | 52/432 |

*Primary Examiner*—James L. Ridgill, Jr.
*Attorney, Agent, or Firm*—Blair, Brown & Kreten

[57] ABSTRACT

Improvements in or relating to prefabricated self-supporting modular room elements for the construction of buildings, including substantially three basic modular elements, one of an inverted "U" shape, one of an inverted "L" shape and a service unit element furnished at their edges with the required means for the joining such as protruding semicircular iron rods, which by crossing themselves form an entire circle, inside which are inserted lengthwise reinforcing iron bars to strengthen the jointing before the grouting of the cement mortar and the horizontal edges are provided with grooves and recesses to receive the panels to be erected is disclosed.

4 Claims, 13 Drawing Figures

PREFABRICATED SELF-SUPPORTING MODULAR ROOM ELEMENTS

FIELD OF INVENTION

This invention relates to improvements in or relating to prefabricated self-supporting modular room elements of vibrated reinforced concrete suitable to construct buildings or dwellings of single or multiple units on a horizontal and/or vertical level wherein the said improvements concern substantially a better shape and structuralization of the single elements and an improved method of joining the elements, providing a more rational utilization and furthermore allowing to employ the elements in antiseismic constructions.

BACKGROUND OF THE INVENTION

Prefabricated elements of various types are known in the prior art which present disadvantages of different natures, as for instance the U.K. Pat. Ser. No. 1,456,645 in the name of NIEVES with the title "CONSTRUCTING BUILDINGS USING PREFABRICATED PARTS" uses elements of different shapes. However to build one single room in this case it is necessary to employ two elements, which have to be joined at half the height of the room sidewalls and in some cases even three joining points are required. Furthermore single slabs are used to form ceilings, which method proves to be very inconvenient and expensive. The U.K. Pat. Ser. No. 913,841 in the name of HENDERSON with the title "A METHOD OF CONSTRUCTING A BUILDING FROM PRECAST CONCRETE COMPONENTS" presents basically the same inconveniences as the preceding one; the U.K. Pat. Ser. No. 1,246,369 in the name of WOOD with the title "MULTI-STOREY BUILDING ASSEMBLY FORMED WITH PRE-FABRICATED MODULES "utilizes elements with joints between two panels, wherein these panels are laterally supported by two other opposing elements; the U.K. Pat. Ser. No. 1,007,144 in the name of PATENT CONCERN N.V. with the title "IMPROVEMENTS IN OR RELATING TO BUILDINGS CONSTRUCTED OF PREFABRICATED ELEMENTS" presents all its elements in a parallelepiped box shape which presents problems and inconveniences in particular as far as the transport to the construction site is concerned; the same problems are provided by the U.K. Pat. Ser. No. 1,429,357 in the name of GORSKI with the title "IMPROVEMENTS IN OR RELATING TO BUILDINGS" which presents also only elements of parallelepiped box shape; and finally the U.K. Pat. Ser. No. 1,382,709 in the name of WEESE with the title "IMPROVEMENTS IN OR RELATING TO BUILDING SYSTEMS" uses a series of parallelogram shaped modules, which originally have a folded state and are erected only at the construction site and this fact naturally causes higher costs in labour particularly for the assembling and joining of these modulars.

SUMMARY OF THE INVENTION

It is accordingly an object of the present invention to overcome the disadvantages of the prior art as mentioned above. For such a solution the innovative essentialities of the present invention comprise three basic prefabricated modular room elements of variable dimensions according to the known particular specific conditions, these elements being of vibrated reinforced concrete and being constructed in a building yard or on site:

One element is shaped like a bridge having a so-called inverted "U" shape and constitutes the standard element for a room, comprising two upright sidewalls and a slab for the ceiling, one element has the shape of an inverted "L" substantially constituting a sidewall and a ceiling of an adjacent room and will be connected to the upper end of a room sidewall, one cell element of parallelepiped box shape is open at the ceiling being intended to form a service unit with the relative aperture for an entrance door, wherein two opposing sidewalls are prolonged beyond the endwall of the said service unit to form a "sheath" for the passage of the service installations, which essentially has an "U" shape sitting on the horizontal level extending towards the outside.

A variation of the inverted "U" shaped element is presented by furnishing it with a frontal groove to receive the upright rectangular panels which form the front closing panels for the said "U" shaped elements which allow apertures for intermediate openings as for instance for windows or lower ones for instance for garages etc.

A further novelty is the furnishing of a multitude of iron rods, protruding in semicircles from the edges of the said elements to effect the jointing and moreover at the base edges are grooves of inverted "U" shape provided to improve the joining facilities and also recesses to favour the jointing. This coupling of said elements is also improved by inserting one ore more binding reinforcing bars lengthwise between the jointing edges, inside the said rings before grouting the binding cement mortar between the elements themselves or between the elements and the eventually preexistent and predisposed structures. The jointing and connecting of the said structures effected with this system are so strong as to resist every horizontal or vertical strain, even dynamic ones, such as telluric events, particularly to earthquakes, creating antiseismic structures giving a maximum of security.

As above mentioned the modification of the inverted "U" shaped element creating "ceiling" elements consists of the fact that contrary to the elements of parallelepiped form this new type of element presents in his frontview a shape of inverted "U" of a rectangular form without a base and in its sideview a a trapezoidal form instead of a rectangular one and the upper panel of the inverted "U" shaped or bridge element instead of being horizontal will be inclined in relation to the slope of the roof.

BRIEF DESCRIPTION OF THE DRAWINGS

The invention will be more evident from the description and the accompanying drawings representing embodiments of the invention, which respectively represent.

DETAILED DESCRIPTION OF THE PREFERRED EMBODIMENT

Figure 3:
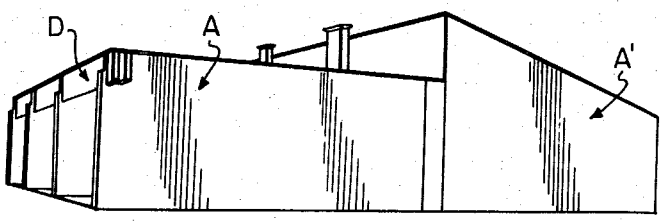

The above mentioned figures illustrate the inverted "U" shaped elements of parallelepiped form (FIG. 1) (A) which present at the end of the upper and lower sidewall edges a multitude of rod irons protruding in semicircles (1,2) on top as well as on the bottom for the entire length, except for two free areas at the extreme ends (3) which constitute the bearing feet for the extrem lower edges.

Between the two bearing feet (3) the recess of the lower edge for the formation of a space (6) is to be noted, which is intended to receive the said semicircled tying iron rods and adjoining the said feet and on the inside between them are grooves (5) provided with an inverted "U" shape to receive the tying stirrups as explained later on.

Figure 1:
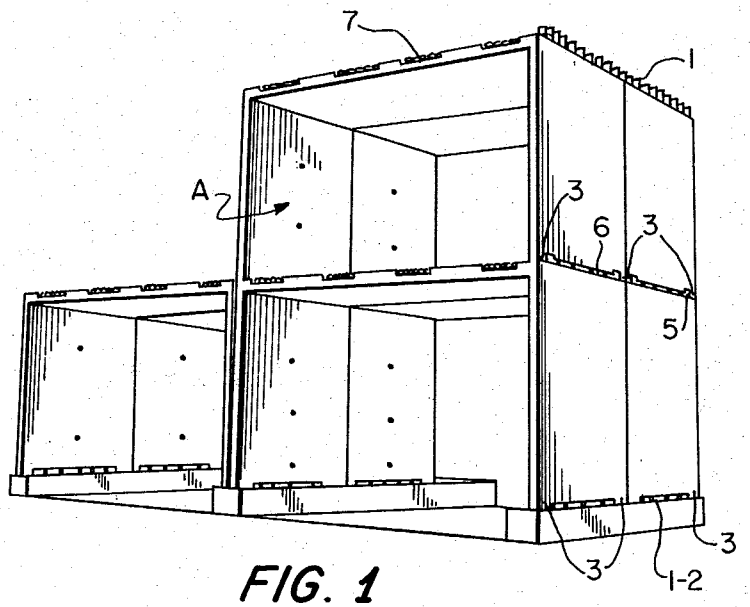
FIG. 1 the system of a few assembled inverted "U" shaped elements disposed side by side and one above the other in a perspective view, FIG. 2 a perspective view of the inverted "L" shaped element supported by the service unit element, FIG. 3 a perspective view of an exemplifying realization of rowhouses with a connected row of garages, FIG. 4 a perspective front view of the structuration of the rowhouses of FIG. 3 from the opposite side, FIG. 5 a perspective view of the inverted "U" shaped elements constituting a ceiling unit in an example of coupling same side by side, FIG. 6 another perspective view of a series of covering elements of inverted "U" shape coupled together as an example, FIG. 7 a close view of a set of inverted "U" shaped elements and service elements in an upright assembled position, a few of the inverted "U" shaped elements forming the ceiling of any one story.

The element of inverted "U" shaped (A) presents furthermore at its terminal edges of the walls and slabs a multitude of tying iron rods for the jointing, spaced in groups (7) which fact will be explained in more detail hereafter, (in this specific case these spaced groups (7) are only shown in the jointing of the headslabs, whereas they are not shown in FIG. 1 at the top edge of the vertical walls, but it is obvious that with this joining system the said groups of iron rods (7) may also be provided at the vertical edges of the sidewalls as it will be explained in detail later on).

Figure 2:
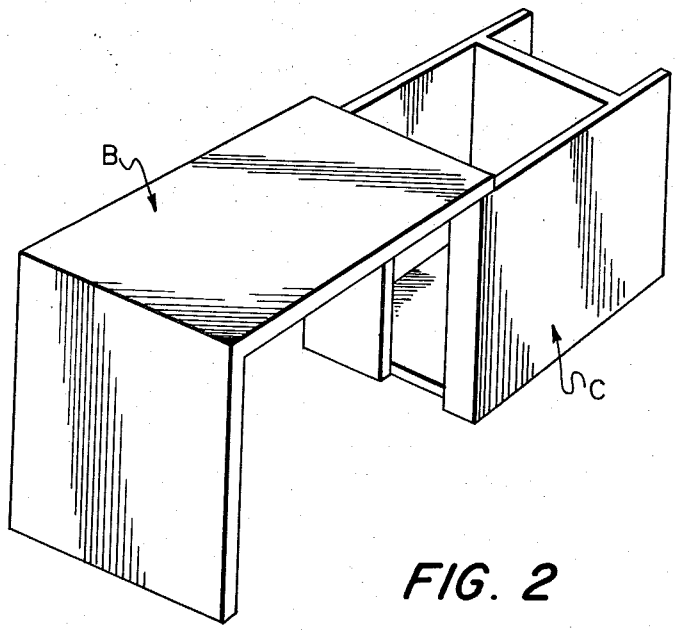

Analogously it is to be understood that the elements of inverted "L" shape (B) and the service elements (C) have the same structure as the "U" shaped elements (A) at the base edges and the lateral edges to effect their joining, even though in FIG. 2 the said forms and structures are not shown to simplify the exemplary scheme of the said figure.

Figure 4:
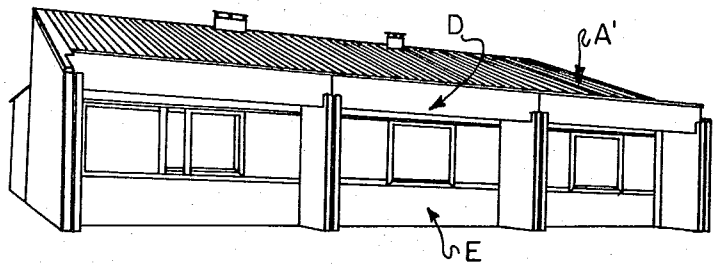

Furthermore the "bridge" or inverted "U" shaped elements as shown in FIG. 3 may vary at the joining of the upper edge and at the joining means at the lower edge to allow the fitting in of such panels as shown respectively as (D and E) in FIGS. 3,4.

Figure 5:
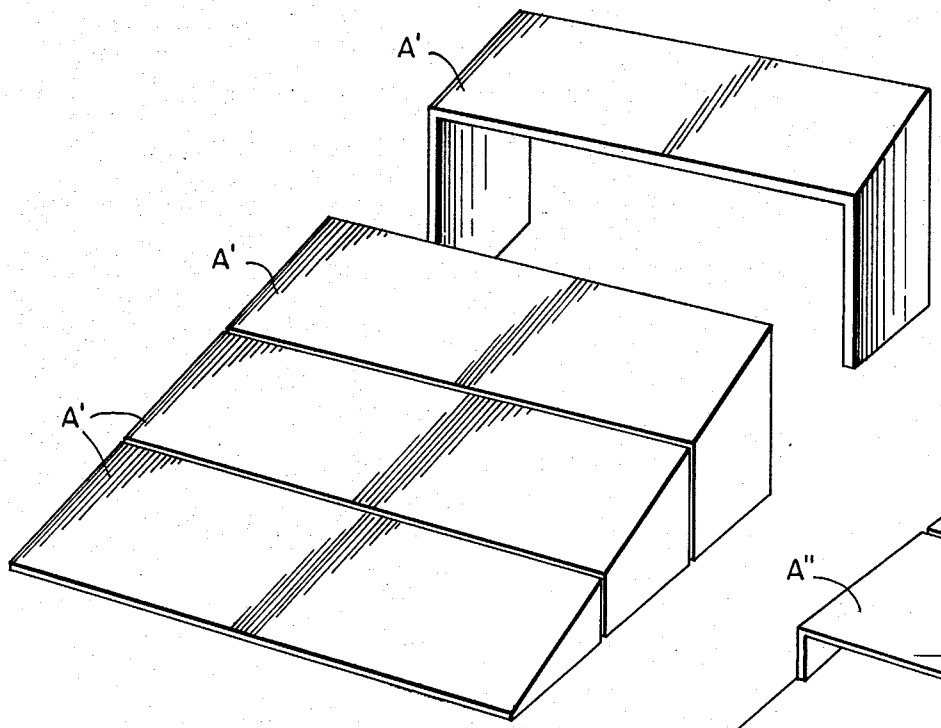

The "bridge" or inverted "U" shaped elements may have trapezoidal shapes as shown as (A') in FIG. 5; they may also have various heights to allow them to be assembled side by side in order to form a continuous roof (A' in FIG. 5); it is also possible to utilize only one of them to construct a dwelling unit, as for instance illustrated in the FIGS. 3 and 4, or a set of them as shown in FIG. 5.

Figure 6:
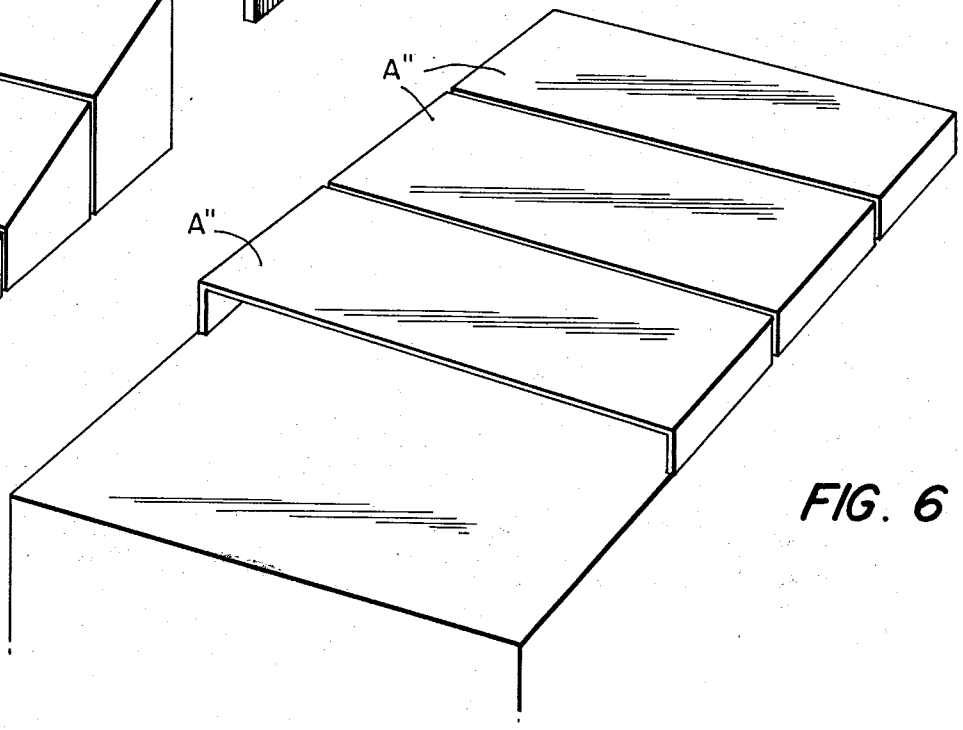

Furthermore the inverted "U" shaped elements may also be considerably shorter than the one that forms a full story in order to realize covering elements only (A") as shown in FIG. 6.

Figure 7:
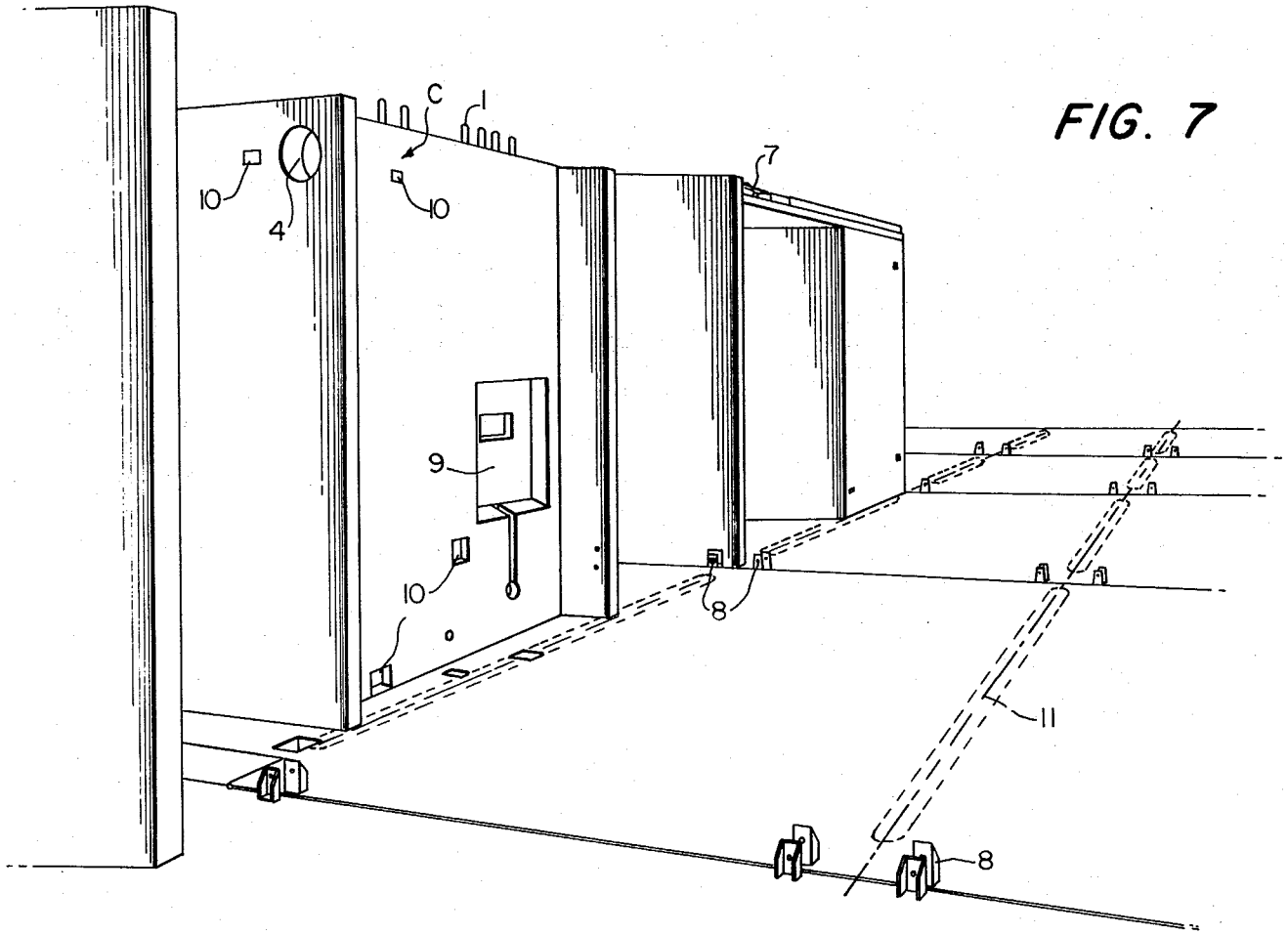
Figure 8:
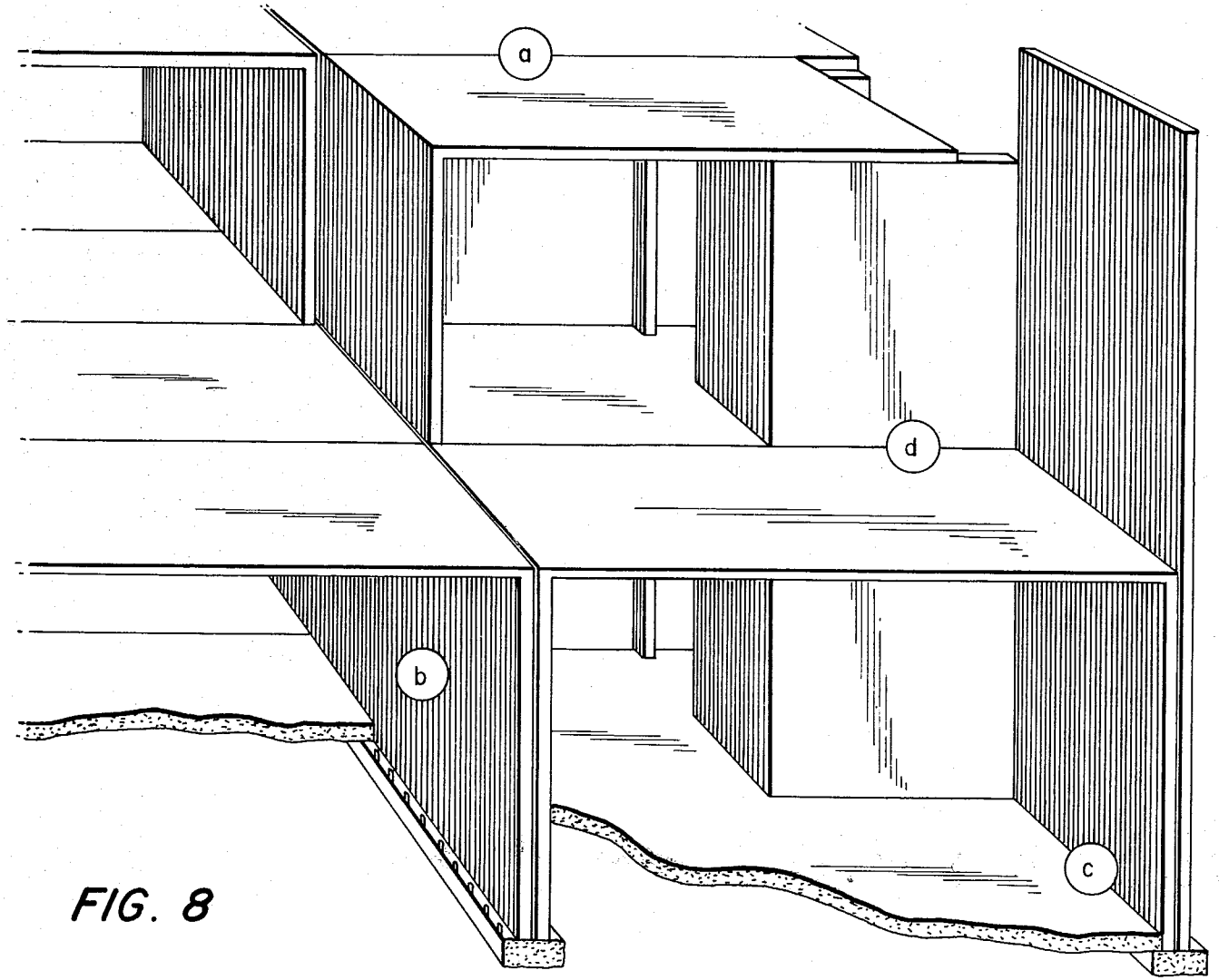
FIG. 8 a schematicised perspective view of a combination of assembled inverted "U" shaped elements, inverted "L" shaped elements and service unit elements, and the letters "a,b,c,d" indicate the positions relating to the new joining system of the elements, FIG. 9 a partial view of the vertical section of the jointing system of the elements in the horizontal level, "a" in FIG. 8, FIG. 10 a top view of the structuralization of the jointing system of FIG. 9, FIG. 11 a partial view of the horizontal section of the joining area between the vertical walls on top of the various elements, "b" in FIG. 8, FIG. 12 a partial view of the vertical section of the joining system at the lower edge of the various elements for the support on the ground on the foundation level "c" in FIG. 8, FIG. 13 a partial sectional view on the vertical level of the longitudinal horizontal joining area of the various elements assembled side by side at the "floor level", "d" in FIG. 8.

For the joining of the elements in cases which do not require antiseismic structures it is obvious that the lower bases of the said elements are mounted directly on the ground as shown in FIG. 7. However in this cases stirrups are always provided which protrude upwards (8) and have a section of an inverted "U" in contraposition with a centerhole to be used for the locating, fastening and centering of the various elements in superimposition.

The FIG. 7 shows particularly the third or posterior part of the service element with the passage section (C) illustrating that the endwall already carries the holes and cavities (9) to receive in this specific case the water-tank for the W.C. and other holes for the utilities inlet and/or outlet for the services (4,10) and as desired other holes for all generally known services.

Furthermore FIG. 7 shows the various inverted "U" shaped elements at the so-called "slab" level presenting between them the various sealings effected with cement mortar (11) the modus of which will be described later on.

In all cases of antiseismic joining or all structures where the building or a monobloc is desired the joining system for the elements is such as shown in FIGS. 8,9, 10,11,12,13.

The figures also show that the edges lying on the vertical level of each element have a semidovetail shape open on one side (12) whereas on the opposite side the end edge touches an adjacent edge (13) and all corners are bevelled (14).

Figure 10:
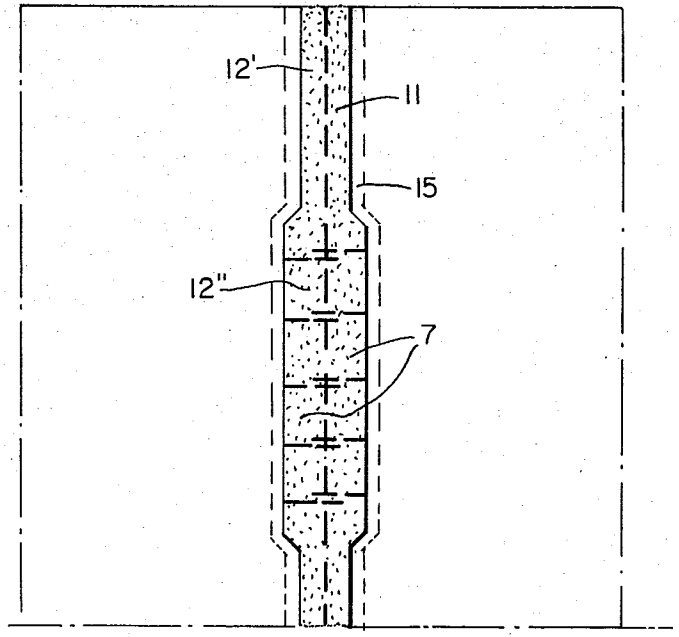

On the part of the hollow undercut of the semidovetail (12) the semicircular reinforcement iron rods (7) cast outwards and cross between themselves to form a full circle and in the center of these circles at least one tying iron bar (15) may be inserted; it is furthermore established that the opening of the dovetail shape assumes varying widths (12',12") precisely more narrow in the area of the sealing with cement mortar only and larger at the area of the tying with the reinforcing bars (7,15) (12" in FIG. 10).

Figure 11:
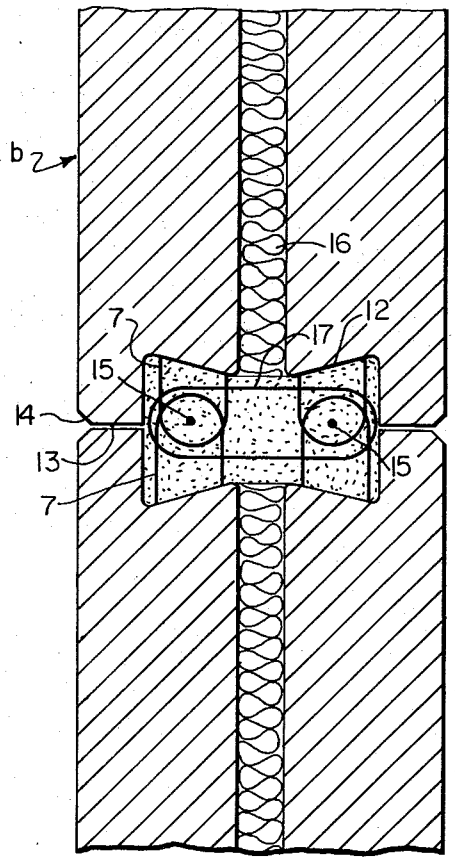

When two vertical walls of two adjacent elements have to be assembled on top as well as side by side a determinate space has to be left between the sidewalls which is to be filled with suitable insulating material (16) in FIG. 11. According to the preceding description tying stirrups are also utilized in the area of the joinings by tying the various elements at a four module corner with loop elements (17); in FIG. 11, with stirrup loops provided around the two adjacent longitudinal bars (15) causing another tying connection of two single adjoining elements.

Figure 12:
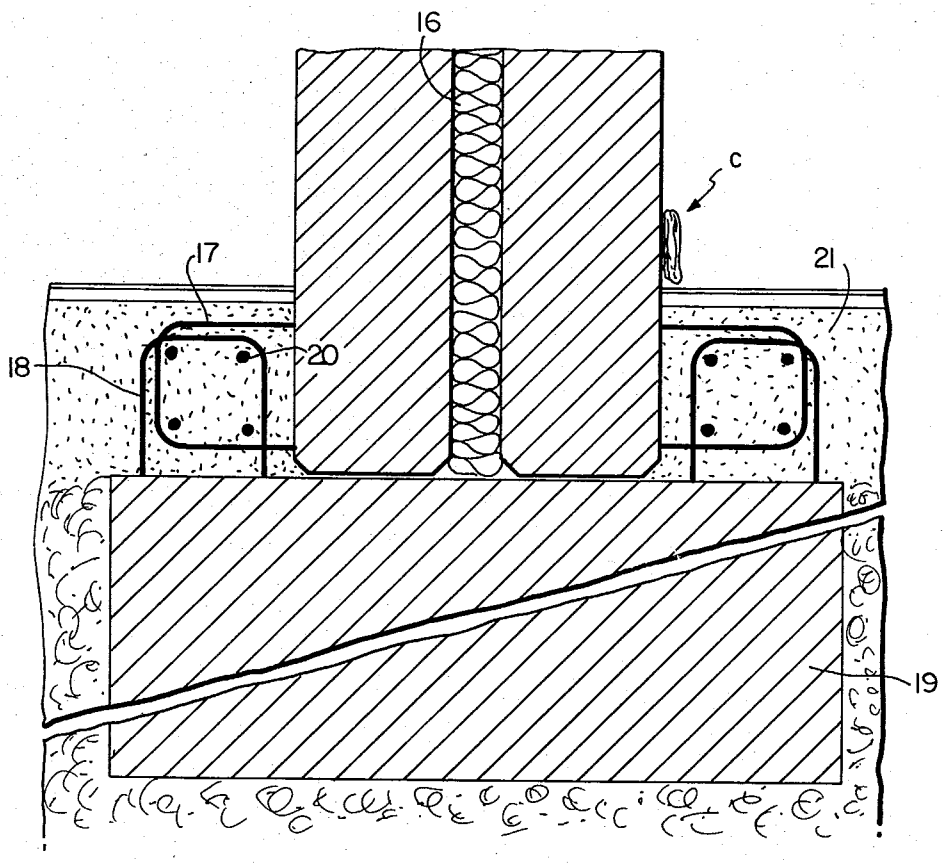

A variation of the lower base end of the inverted "U" shaped elements set on the ground, particularly for structures in elevation is shown in FIG. 12, wherein the said semicircular rods are projecting out sideways (17) from the base element to connect with the semicircular rods (18) emanating out of the foundation (19) with a few longitudinal tying bars (20) inserted inside of the so created circles before the grouting of the base (21) of the set is effected.

Figure 13:
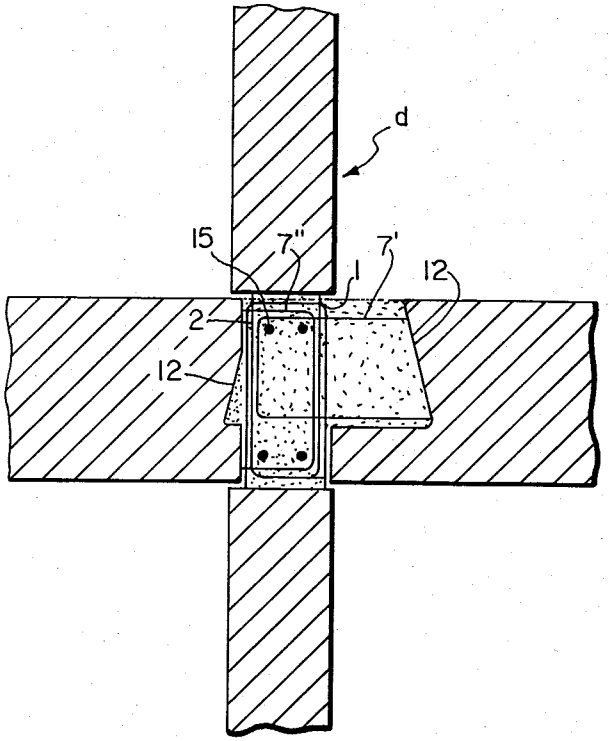

The connection of the edges on the floor and in crossing superimposition ("d" in FIG. 8) is clearly evident in FIG. 13, showing the utilization of the said semicircular rods (1,2), however in this specific case they have a rectangular shape and cross the semicircular or arcuate rods (7',7''), which in this specific case are also of a rectangular shape. They are used in the respective different heights within the dovetail shape (12) or in the entire thickness, before finally a few bars (15) tying the said semicircles are inserted.

Figure 9:
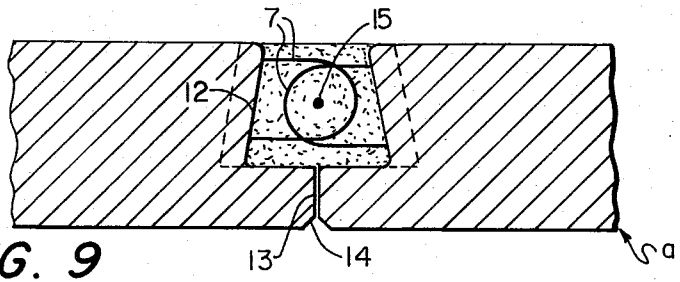

Naturally the dovetail groove or semidovetail groove on the external edges or on one section of the external edges of the various elements may be more or less deep, more or less outlined and more or less symmetrical (example FIG. 13), contrary to the symmetric jointings shown in the normal cases of the FIGS. 9,10,11.

This dissymmetry is required to allow the installation of single dividing wall elements (example FIG. 13) instead of two adjacent walls which would form a gap (example FIG. 11)and also to facilitate the casting.

It is evident that the invention is not limited to the embodiments heretofore described and represented, and that other means and embodiments may be derived therefrom without leaving the scope of the invention.

What is claimed:

1. A building formed from plural precast, inter-connected elements in which said elements are adapted to be oriented into a plurality of configurations comprising: a first element having edges defined by a substantially inverted "U" shaped configuration including vertical legs and a planar top portion canted relative to a horizontal plane whereby a plan view of either of said vertical legs would define a trapezoid and means along the edges thereof to fasten said first element further including a second element having edges defined by a substantially inverted "L" shaped configuration including one vertical leg and one horizontal leg having means along the edges thereof to fasten said second element to another element including a third element having edges defined by a parallelepiped box shape, open along its top extent, having a door-type passageway on a first vertical wall, second and third opposed walls orthogonally fastened to said first wall, and a fourth wall facing said last named wall wherein said second and third walls extend beyond said first and fourth walls thereby providing an outwardly extending sheath, and means along the edges to fasten said third element to another element wherein said means along the edges to fasten said elements includes a recess along said edge, and an iron bar extending into said recess from one wall's edge of said element, said iron bar forming a loop in said recess and extending back into said one wall's edge and in which a first set of two of said elements have their recesses in registry whereby their respective loops overlap further including a tying bar extending through said loops and said recesses are filled with cementitious material and wherein said first set of elements is fastened to a supporting base through stirrup means, in which said stirrup means is defined by a pair of U-shaped elements embedded in said base and extends upwardly therefrom facing each other such that an open area of each U stirrup faces away from each other and a wall of an element is affixed therebetween.

2. The device of claim 1 in which a second set of two elements have their recesses in registry with said first set and an iron loop extends over each tying bar and the cementitious material extends between said two sets of elements at the recess area.

3. The device of claim 2 in which insulation is disposed between said first and second sets at their juncture.

4. The device of claim 3 in which said recess is of semi-dovetail shape.

* * * * *